United States Patent [19]

Otto

[11] Patent Number: 4,570,463

[45] Date of Patent: Feb. 18, 1986

[54] NEEDLE SELECTION DEVICE FOR A KNITTING MACHINE

[75] Inventor: Günter Otto, Couvet, Switzerland

[73] Assignee: Edouard Dubied & Cie. S.A., Couvet, Switzerland

[21] Appl. No.: 562,729

[22] Filed: Dec. 19, 1983

[30] Foreign Application Priority Data

Dec. 22, 1982 [CH] Switzerland ..... 7483/82

[51] Int. Cl.[4] ..... D04B 15/78; D04B 9/06

[52] U.S. Cl. ..... 66/221; 66/25

[58] Field of Search ..... 66/25, 218, 219, 220, 66/221, 222, 75.2

[56] References Cited

U.S. PATENT DOCUMENTS

| | | | |
|---|---|---|---|
| 3,340,708 | 9/1967 | Krause | 66/75.2 |
| 3,365,915 | 1/1968 | Schmidt | 66/25 |
| 3,534,566 | 10/1970 | Farmer et al. | 66/221 |
| 3,616,654 | 11/1971 | Llinas | 66/25 |
| 3,667,254 | 6/1972 | Paepke | 66/219 X |
| 3,863,465 | 2/1975 | De Cerjat et al. | 66/219 |
| 3,930,383 | 1/1976 | Nuber | 66/25 |
| 3,971,233 | 7/1976 | Amaya et al. | 66/220 |
| 4,414,806 | 11/1983 | Schimko | 66/75.2 |
| 4,481,793 | 11/1984 | Cuche et al. | 66/75.2 |

FOREIGN PATENT DOCUMENTS

| | | | |
|---|---|---|---|
| 1163052 | 9/1969 | United Kingdom | 66/75.2 |

*Primary Examiner*—Wm. Carter Reynolds
*Attorney, Agent, or Firm*—Fred A. Keire

[57] ABSTRACT

A needle selection device for use in a knitting machine having revolving needle carriers and including pivotable selectors that operate to bring one end of each selector into actuating relation with a respective needle. A jack is coupled to the needle and, depending upon the pivot position of the selector, moves between an active position to cause that needle to be selected for operation and an inactive preset position by which that needle is not selected. A spring is associated with the jack to bias the jack to its active position. The pivot position of the selector is electromagnetically controlled.

11 Claims, 8 Drawing Figures

NEEDLE SELECTION DEVICE FOR A KNITTING MACHINE

BACKGROUND OF THE INVENTION

This invention relates to a needle selection device of the type used in a knitting machine and, more particularly, to such a device which is electromagnetically controlled and is used in a circular knitting machine to select the needles carried by one of a pair of revolving needle carriers, known as dial needles. This invention is particularly useful in knitting machines that are readily adapted to produce patterned fabrics, selvedged fabrics or other conventional knitted fabrics for typical body sizes, as well as fabrics of higher gauges.

Circular knitting machines are particularly adapted for attractive designs, such as Jacquard designs. Typically, needle selection for executing such designs by circular knitting machines is carried out by way of mechanical or electromagnetic selector devices. However, most of these selector devices have been designed to select needles which are mounted as so-called "cylinder needles", and are not easily adapted for use with so-called "dial needles" that advantageously are carried by some circular knitting machines.

A mechanical pattern-forming device is known from U.S. Pat. No. 3,646,779 in which a mechanism of the type that has been used to knit a pattern by way of "cylinder needles" operates with "dial needles" to produce knitted fabrics with patterns on both sides (or surfaces). In one embodiment, selectors which operate (e.g. they move or pivot) in accordance with the pattern being knitted drive jacks which, in turn, move dial needles associated with those jacks into knitting position. As one example, the selectors raise the jacks which, in turn, move the knitting needles. However, this mechanical pattern producing device with its needle selection mechanism is of relatively complex structure and limits the possibilities of needle selection. This device is better suited for use with multi-feed circular knitting machines whose needles are mounted in needle carriers, so-called cylinder and dial, of rather large diameter.

In addition to the aforementioned mechanical selection device, electromagnetic selection apparatus is known from Swiss Pat. No. 213,033 for use with needles arranged in a ring (referred to herein as dial needles). In this electromagnetic selector, a magnet is used to move control elements of a pattern wheel, these elements being shifted into a guide way, thereby moving the knitting needles into operating position. The pattern wheel typically is disposed behind the dial needles, and the direct movement of the control elements of this wheel under the action of the selector magnet may require a high degree of accuracy and precise tolerances of the individual operating elements. Furthermore, this device generally needs a considerable amount of space in the interior of the ring of needles or dial.

OBJECTS OF THE INVENTION

Therefore, it is an object of the present invention to provide a relatively simple needle selection device which overcomes the drawbacks and disadvantages attending the aforementioned prior art systems.

Another object of this invention is to provide a needle selecting device that is particularly useful in a circular knitting machine and that relies upon one or more electromagnets for needle selection.

A further object of this invention is to provide a needle selection device for use in a circular knitting machine whose needles are arranged in a ring of relatively small diameter.

An additional object of this invention is to provide a compact, relatively simple yet accurate electromagnetically-controlled needle selection device for a knitting machine.

Various other objects, advantages and features of the present invention, as well as other embodiments, will be readily appreciated from the following detailed description, and the novel features will be particularly pointed out in the appended claims.

BRIEF DESCRIPTION OF THE DRAWINGS

The following detailed description, given by way of example, and not intended to limit the present invention solely to the described embodiment, will best be understood in conjunction with the accompanying drawings in which.

DETAILED DESCRIPTION OF A CERTAIN PREFERRED EMBODIMENT

Figure 1:
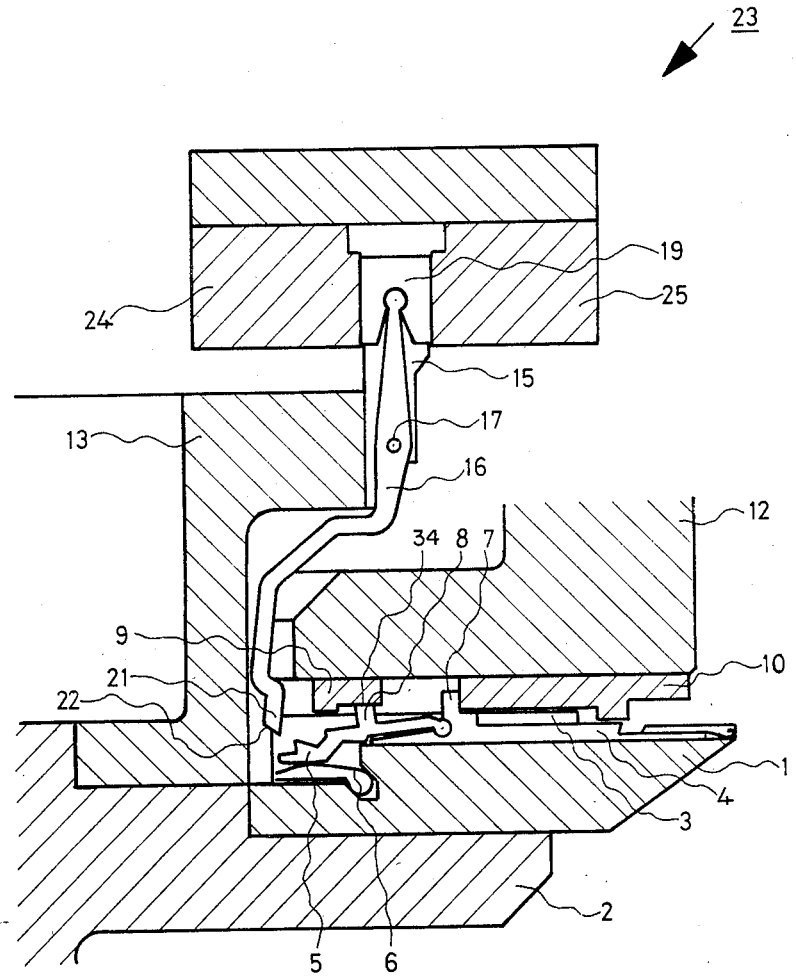
FIG. 1 is a sectional view taken through a needle selection device whose needle carrier is positioned at a location commensurate with the beginning of needle selection.

Referring now to the drawings, wherein like reference numerals are used throughout, FIG. 1 represents one embodiment of the needle selection device in accordance with the present invention, disposed in the condition normally assumed thereby at the beginning of a selection operation. As will be understood, the needle selection device of this invention is particularly adapted for use in a circular knitting machine of the type having a pair of revolving needle carriers upon which the individual knitting needles are supported. One of the pair of needle carriers typically is arranged as a ring, called dial, having individual compartments therein for receiving and carrying respective needles and actuating apparatus by which that needle is driven into and out of operating position.

Figure 4:
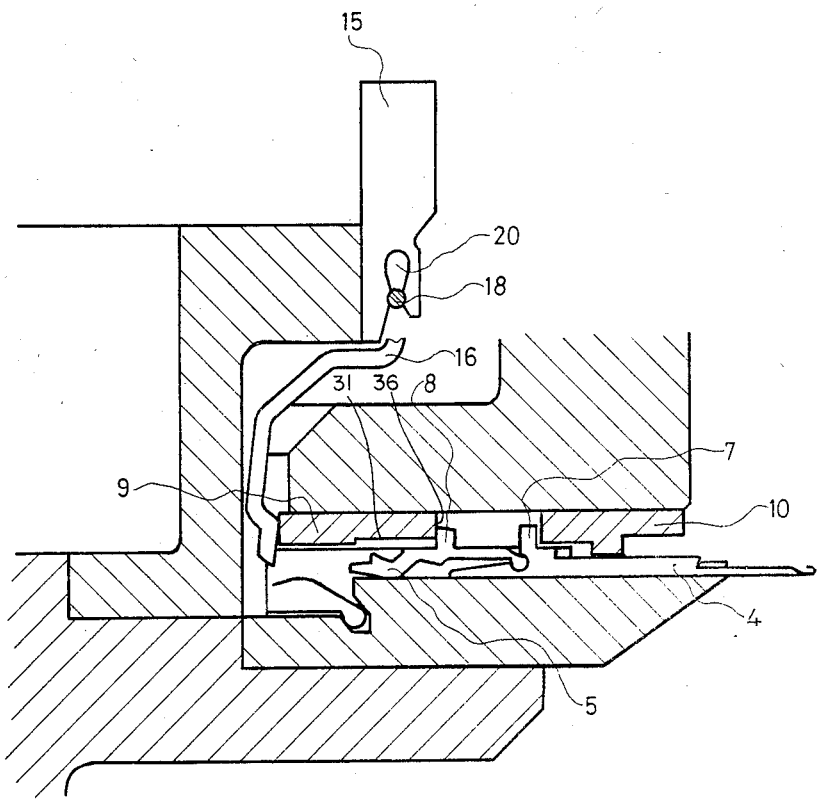
FIG. 4 is a sectional view similar to FIG. 1 with the needle carrier being advanced and the selected needle being operatively positioned.
Figure 5:
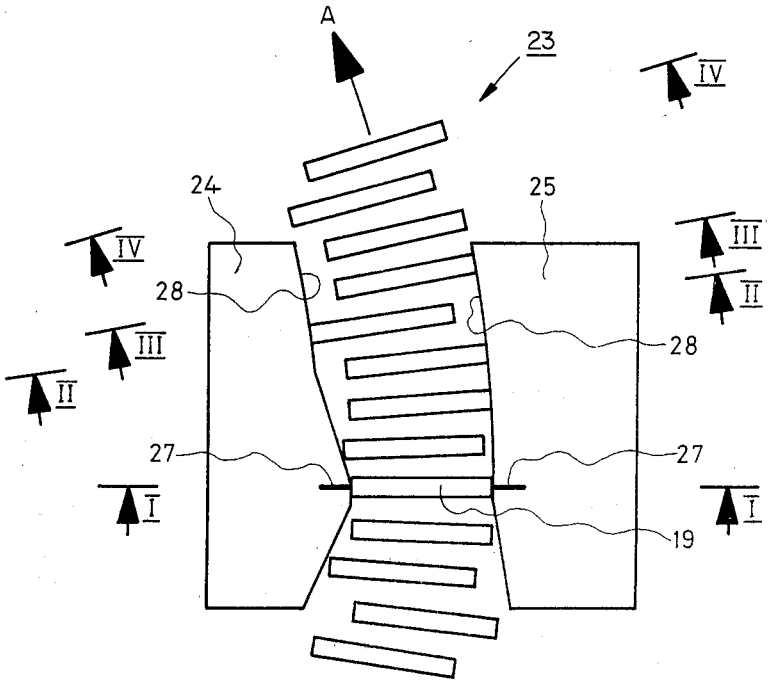
FIG. 5 is a top plan view of a selector station incorporating the needle selection device of the present invention, and with the needle carrier being advanced to the position shown in FIG. 1 (taken along the line I—I in FIG. 5), to the position shown in FIG. 2 (taken along the line II—II of FIG. 5) to the position shown in FIG. 3 (taken along the line III—III of FIG. 5), and to the position shown in FIG. 4 (taken along line IV—IV of FIG. 5)

As shown in FIG. 1, a needle carrier 1 of annular construction is supported on a supporting plate 2 and is adapted to rotate about a suitable axis of rotation in the direction indicated by arrow A of FIG. 5. A plurality of needles is supported on, or carried by, needle carrier 1, these needles being arranged radially and adapted to be moved in the radial direction from an inoperative position (such as shown in FIG. 1, wherein one of these needles is not selected) to an operative position (such as shown in FIG. 4, wherein the needle is selected and is displaced in the radially outward direction). Each needle 4 may be positioned in a radial slot disposed on, for example, the upper surface of needle carrier 1, or in slots which are formed by inserted steel tricks 3 (the details of which are omitted).

The trailing end of needle 4 (it is assumed herein that the leading end of the needle is moved to extend radially outward beyond the needle carrier, as shown in FIG. 4) has pivotally secured thereto a jack 5. As will be described, the jack is permitted to pivot between an inactive position (shown in FIGS. 1 and 2) and an active position (shown in FIGS. 3 and 4). A spring 6, such as a bow spring, also is carried by needle carrier 1 and is disposed beneath jack 5 to exert a bias force on the jack which normally urges the jack to its active position. That is, the spring force exerted on jack 5 tends to pivot the jack about its pivot connection to needle 4 in the clockwise direction, as illustrated in the sectional views.

An upstanding projection, or butt 7 is provided on needle 4 and, similarly, an upwardly projecting butt 8 is provided on jack 5. Stationary cam surfaces 9 and 10 are mounted on a cam box 12 (the details of which are omitted) which also is stationary. As needle carrier 1 revolves about its axis of rotation, butts 7 and 8 are rotated into engagement with surfaces of cams 9 and 10, thereby following these cam surfaces to displace the needle and jack as a result of the force exerted on the respective butts by such surfaces. Butt 8 is permitted to engage surface of cam 9 if jack 5 has been pivoted to its active position, such as the position shown in FIGS. 3 and 4. When in engagement with this cam surface, the butt functions as a cam follower such that, when needle carrier 1 rotates, the force exerted on the butt by the cam surface drives jack 5 radially outward, thereby displacing needle 4 to its operative position. As the needle carrier continues to rotate, butt 7 functions as a cam follower to engage surface of cam 10, whereby a retracting force is exerted thereby to displace needle 4 and jack 5 coupled thereto in the radially inward direction. This retracts the needle if it had been selected, and restores the needle and jack coupled thereto to a preset, beginning position. These cams and their surfaces are described in more detail with respect to FIGS. 6–8.

An annular body 13, coaxial with the rotary axis about which needle carrier 1 revolves, is disposed above the needle carrier and is supported on support plate 2 to be spaced from needle carrier 1, as illustrated. Annular body 13 is provided with slots which are adapted to support a plurality of pivotable selectors which is equal in number to the number of needles 4 carried by needle carrier 1. That is, a respective pivotable selector preferably is provided for each needle. In the embodiment shown herein, the aforementioned slots in annular body 13 are formed by nonmagnetic tricks 15 (shown more fully in FIG. 4) which are supported by body 13. A pivotable selector 16 in the form of an elongated member, known also as a swing jack, is disposed in the slot formed by trick 15 and is supported at a pivot axis 17 in the slot. More particularly, the pivot axis, which may be formed as a pivot pin 18 on selector 16, shown in FIG. 4, is clamped in an opening 20 formed in the lower portion (as viewed in the drawing figures) of trick 15. Preferably trick 15 is constructed of resilient material, and opening 20 is formed as an elongated notch having a pinched central portion for releasably holding pivot axis 18 and a relatively wider inlet portion which, during assembly, receives and guides pivot axis 18 to the pinched central portion wherein it is clamped. Notch 20 of trick 15 thus constitutes a "snap-in" fitting for the pivot axis of pivotable selector 16. It will be appreciated, from the description below, that the pivotable selector is permitted to pivot, within a limited range, about this pivot axis.

The upper end of pivotable selector 16 (as viewed in FIGS. 1–3) is articulated to a selector member 19. Preferably, the selector member is constructed of, or includes, ferromagnetic material so as to be electromagnetically attracted to one of two opposite poles that are disposed at a selector station 23 (shown more fully in FIG. 5). Selector 19 may be guided by the same trick 15 as is pivotable selector 16.

The lower end of the pivotable selector is provided with a nose 21 whose surface 22 is inclined in the manner generally illustrated. Preferably, this surface lies in a plane that is substantially normal to the radius which extends thereto from pivot axis 17. Pivotable selector 16 may be sufficiently thin that surface 22 may be thought of merely as an inclined edge of nose 21.

As shown in FIG. 5, the rotation of needle carrier 1 about its axis brings successive selectors 19, pivotable selectors 16, jacks 5 and needles 4 past selector station 23. If desired, a number of such selector stations may be disposed in the path of selectors 19, and FIG. 5 illustrates only one such station. The selector station is comprised of two spaced members 24 and 25 which define an inlet, an outlet and a relatively narrow throat therebetween. A pair of electromagnetic poles 27 is disposed at the throat of the selector station and, downstream of these poles, permanent magnet holding poles 28 are provided in the outlet portion on each member 24 and 25. Depending upon which electromagnetic pole is energized, selector 19 is attracted thereto and remains adjacent the permanent magnet pole that is downstream of this energized electromagnetic pole. Thus, when viewed in FIG. 5, a selector may be shifted to the left or to the right, depending upon whether the left-hand or right-hand electromagnetic pole is energized. As will be described, this selective energization of the electromagnetic poles serves to select the needle that is associated with selector 19 which passes these poles.

Figure 6:
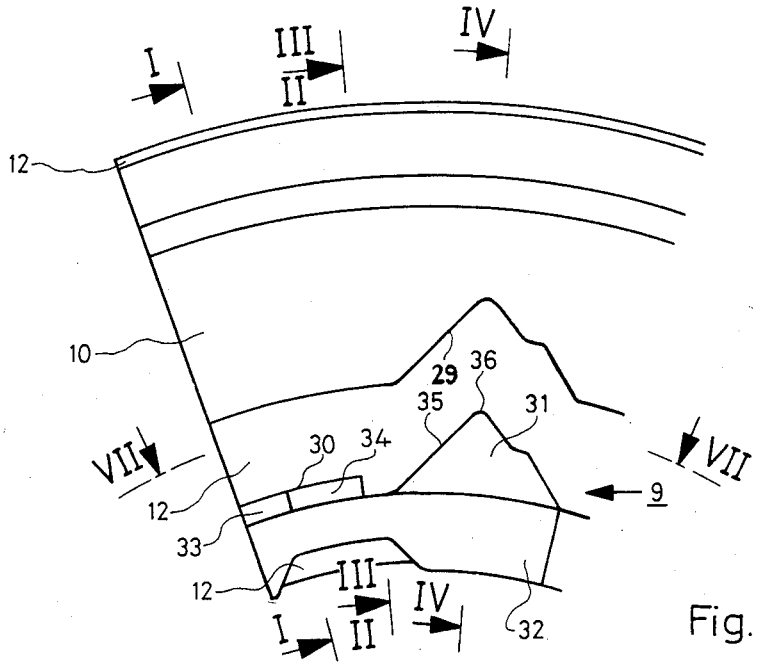
FIG. 6 is a partial inverted-plan view of two associated cams fixed to a cam box with lines I—I, II—II, III—III and IV—IV representing the positions shown in FIGS. 1-4, respectively, to which the needle carrier is advanced.
Figure 7:
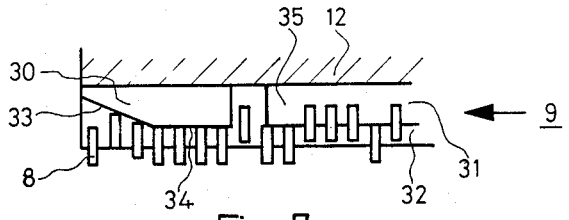
FIG. 7 is a sectional view taken along the line VII—VII in FIG. 6.
Figure 8:
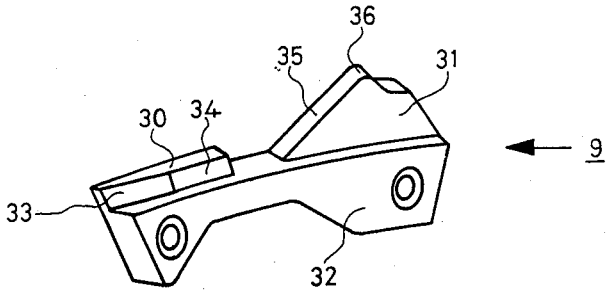
FIG. 8 is a perspective view of the lower cam in FIG. 6.

FIG. 6 shows an inverted-plan view of cam 9 and cam 10 of FIGS. 1 to 4 both of which are fixed to cam box 12. Cam 10 has a cam surface 29 which is perpendicular to the plane of the drawing. Cam 9 has two cam members 30 and 31 on a common support 32 which is fixed to cam box 12, for example, by screws (FIG. 8). Cam member 30 has an entrance ramp 33 on its front side (FIGS. 6 to 8) which continues as a straight surface 34 (see FIG. 1). Cam member 31 has a ramp surface 35 (shown also in FIGS. 2 and 3) on its upper side which rises to a top 36 (see FIG. 4) and then descends again. In FIG. 7 butts 8 of jacks 5 (FIGS. 1 to 4) are shown in various positions against entrance ramp 33, straight surface 34 and ramp surface 35. These positions will be described below.

The manner in which the illustrated needle selector apparatus operates now will be described. As needle carrier 1 rotates a needle to the position represented by line I—I of FIG. 5, butt 8 of jack 5 engages a suitable entrance ramp 33 of cam member 30 leading to cam surface 34 of that cam member, which, in turn exerts a downward force on the butt, as seen in FIGS. 1, 6, 7 and 8. Hence, jack 5 is pivoted in the counterclockwise direction, overcoming the bias force exerted thereon by spring 6, to assume its normally inactive preset position as shown in FIG. 1. As also shown in FIG. 1, selector 19 is constrained in the throat defined by members 24 and 25 of selector station 23. Thus, nose 21 of the lower end of pivotable selector 16 is removed from the free end of jack 5. Furthermore, it will be appreciated that, as needle carrier 1 rotates to the position represented by line I—I, cam surface 29 of cam 10 (see FIG. 6) exerts a retractive force on butt 7, whereupon needle 4 and jack 5 slide radially inward to the non-selected position.

Figure 2:
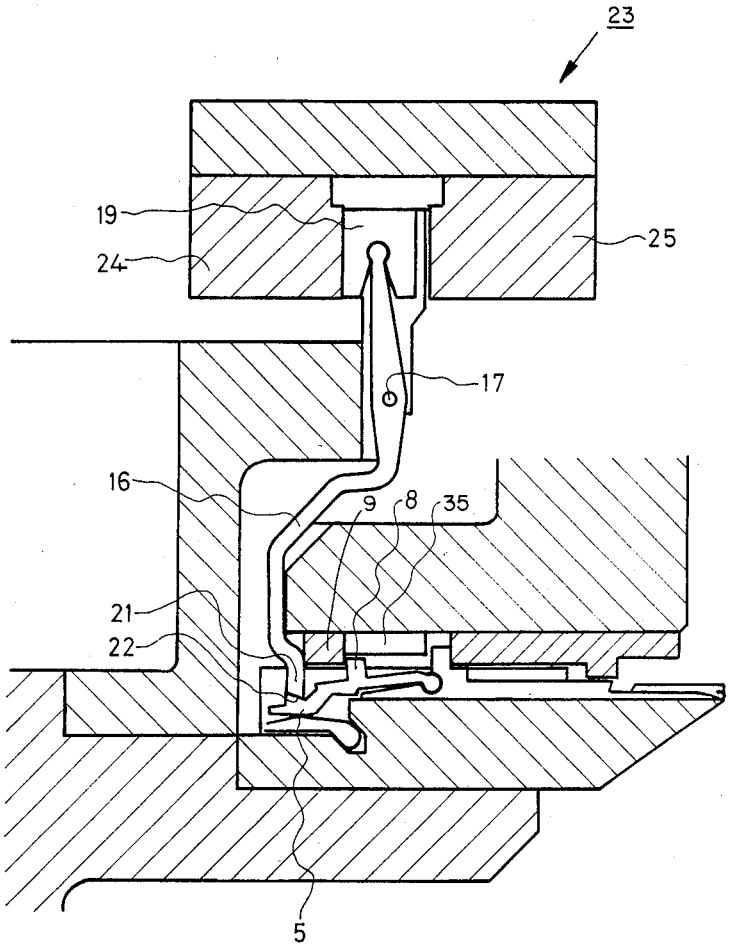
FIG. 2 is a sectional view, similar to FIG. 1, with the needle carrier advanced and with a needle being not selected.

Let it be assumed that the illustrated needle 4 is not selected. Hence, in FIG. 5, the left-hand electromagnetic pole 27 is energized. This attracts selector 19 and, when further rotation of the needle carrier moves the selector out of the throat defined by members 24 and 25, selector 19 remains attracted to left-hand member 24. Let it be assumed that the needle has rotated to the position represented by line II—II in FIG. 5. Since selector 19 is shifted to the left, pivotable selector 16 rotates in the counterclockwise direction about pivot axis 17 such that nose 21 contacts the free end of jack 5, as shown in FIG. 2.

The downward force exerted on jack 5 by nose 21 tends to pivot the jack in the counterclockwise direction to overcome the spring bias force exerted thereon by spring 6. Hence, butt 8 remains free of ramp surface 35 of cam member 31 when needle carrier 1 rotates thereto. As a consequence, jack 5 remains in its inactive preset position by reason of the downward force exerted thereon by pivotable selector 16, and as represented by the lower row of butts 8 in FIG. 7. Since butt 8 now remains free of ramp surface 35, jack 5 is not driven radially outward and, therefore, needle 4 is not displaced to its operative position.

Figure 3:
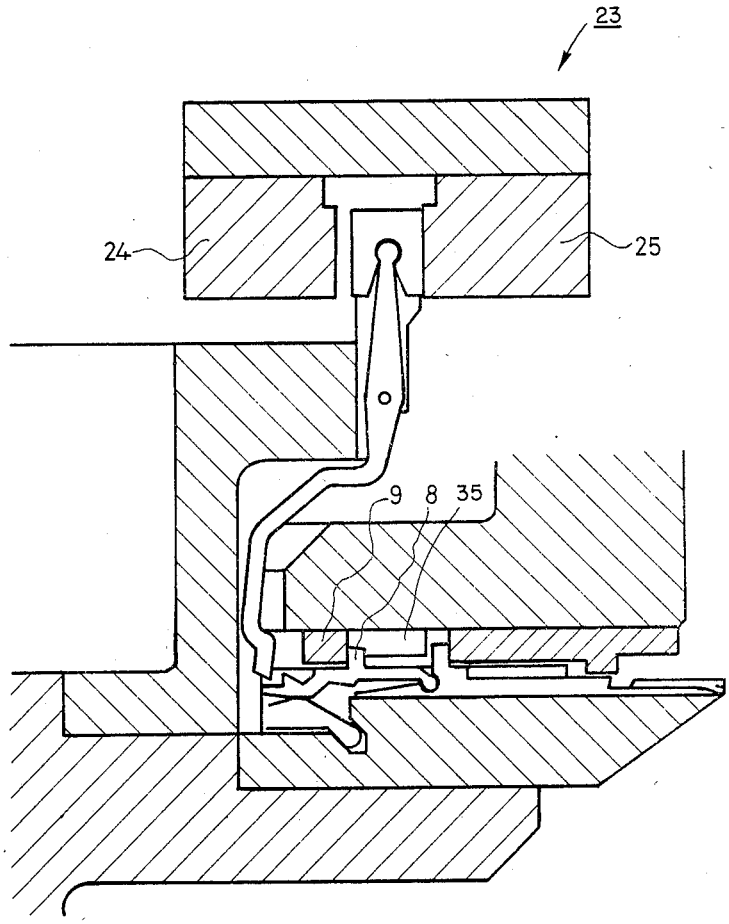
FIG. 3 is a sectional view similar to FIG. 1 with the needle carrier advanced and with the needle being selected.

Let it now be assumed that, when needle carrier 1 rotates to the position represented by line I—I, the right-hand electromagnetic pole 27 is energized. As a result, selector 19 is attracted to permanent magnet holding pole 28 disposed on the right-hand member 25 and, thus, shifts to the right. When the needle carrier rotates to the position represented by line III—III, also shown in FIG. 3, pivotable selector 16 will remain in its position as shown in FIG. 3 without rotating about pivot axis 17. Thus, nose 21 does not contact the free end of jack 5, as shown in FIG. 3, whereby the spring bias force exerted on the jack by spring 6 pivots the jack in the clockwise direction to raise butt 8 into position to engage surface 35 of cam member 31. As needle carrier 1 rotates further, butt 8 rides along the ramp surface 35, represented by the upper row of butts in FIG. 7, to top portion 36 and is driven radially outward to displace needle 4 to its operative position shown in FIG. 4. Thus, it is seen that, when pivotable selector 16 remains in its position as shown in FIGS. 1 and 3, jack 5 is permitted to rotate from its inactive preset position (FIG. 1) to its active position (FIG. 3) to engage butt 8 thereon against ramp surface 35.

It is appreciated that, depending upon which electromagnetic pole 27 is energized, selector 19 is shifted in one of two opposite directions to pivot selector 16 so as to selectively actuate needle 4. Of course, if actuated, the needle is not displaced to its operative position until, as described in the present example, needle carrier 1 rotates to the location at which jack 5 is driven by ramp surface 35 to displace the needle. Normally, the jack is pivoted in response to the spring bias force exerted thereon to engage butt 8 against the ramp surface, thereby displacing needle 4, unless the jack is prevented from pivoting by reason of the contact thereon of nose 21 of pivotable selector 16.

As mentioned above, it is preferred that surface 22, or the inclined edge, at the lower end of pivotable selector 16 be substantially normal to the radius thereto from pivot axis 17. This is preferred because it inhibits, or at least minimizes, torque that might develop due to the upward movement thereagainst by the free end of jack 5 when the latter is subjected to the upward bias force from spring 6. It is appreciated that such torque could pivotally drive selector 16 in the clockwise direction, thereby releasing jack 5 to its active position.

As needle carrier 1 continues to rotate, butt 7 on needle 4 engages surface 29 of cam 10 (FIGS. 4 and 6) and is driven thereby in the radially inward direction. This displaces needle 4 inward along the needle carrier, and also displaces jack 5 in the same direction. The jack and needle combination thus return to the position shown in FIG. 3.

When the needle carrier continues to rotate to bring needle 4 to the entry of another selector station, entrance ramp 33 provided thereat contacts butt 8 to pivotally drive jack 5 in the counterclockwise direction. This presets the jack to its inactive position (FIG. 1), awaiting the selective pivoting of selector 16.

It is appreciated that one or several selector stations may be provided; and the aforementioned needle selecting operation may be carried out at each.

While the present invention has been particularly shown and described with reference to a preferred embodiment thereof, it will be readily appreciated by those of ordinary skill in the art that various changes and modifications may be made, and other embodiments are envisaged. It is intended that the appended claims be interpreted as including the foregoing as well as other embodiments, changes and modifications.

I claim:

1. In a needle selection device of the type used in a knitting machine having revolving needle carrier means for carrying needles to a selector station which includes electromagnetic selection means, apparatus comprising one pivotable selector means for each respective needle, said pivotable selector means being disposed remote from said needle carrier means and having one end thereof selectably driven by said electromagnetic selection means to pivot said pivotable selector means about a pivot axis and another end thereof for actuating said respective needle carried by said needle carrier means; a jack supported on said revolving needle carrier means and coupled to said needle and pivotable between an active position for causing the needle coupled thereto to be selected for operation and an inactive position by which said needle coupled thereto is not selected for operation, said jack being selectively contacted by said other end of said pivotable selector means to determine whether said jack pivots to said active or inactive position; and spring means associated with said jack for exerting a bias force thereon to normally urge said jack to said active position thereof.

2. The apparatus of claim 1 wherein said pivotable selector means is selectively pivoted to contact said other end thereof against said jack and thereby overcome the bias force exerted on said jack by said spring means, whereby said jack assumes the inactive position thereof.

3. The apparatus of claim 2 further including means for presetting said jack to the inactive position thereof prior to the selected driving of said pivotable selector means.

4. The apparatus of claim 1 wherein said jack includes a projecting butt thereon cooperative with a guide surface when said jack pivots to said active position for moving said jack and said needle coupled thereto into operating condition, said butt being free of said guide surface when said jack is in said inactive position.

5. The apparatus of claim 4 wherein said guide surface comprises the surface of a cam member.

6. The apparatus of claim 5 wherein said cam member includes an entrance ramp for guiding said butt to a preset position prior to the selected driving of said pivotable selector means; and wherein said revolving needle carrier means carries the needle and jack coupled thereto to said entrance ramp of said cam member.

7. The apparatus of claim 6 wherein said preset position is said inactive position and wherein said butt remains free of said cam member surface when contacted by said pivotable selector means.

8. The apparatus of claim 1 wherein said pivotable selector means comprises a respective elongated member for each needle and mounted for movement with said revolving needle carrier means, said elongated member being pivoted about the pivot axis of said selector means, said pivot axis being disposed intermediate the ends of said elongated member.

9. The apparatus of claim 1 wherein said other end of said pivotable selector means is provided with a nose for contacting said jack, said nose having a surface lying generally in a plane that is substantially normal to a radius from that plane to said pivot axis.

10. The apparatus of claim 1 further comprising support means for supporting the pivot axis of said pivotable selector means, said support means being mounted for movement with said revolving needle carrier means, formed of resilient material and having an opening therein for receiving and clamping said pivot axis.

11. The apparatus of claim 10 wherein said opening includes an elongated notch having a pinched central portion for releasably holding said pivot axis and a relatively wider inlet portion for receiving and guiding said pivot axis to said pinched central portion during assembly thereof.

* * * * *